United States Patent [19]

Walker

[11] Patent Number: 4,640,319

[45] Date of Patent: Feb. 3, 1987

[54] AUTOMATIC TIE GUN

[75] Inventor: John G. Walker, Hamble, England

[73] Assignee: Bowthorpe-Hellermann Limited, Crawley, England

[21] Appl. No.: 695,699

[22] Filed: Jan. 28, 1985

Related U.S. Application Data

[63] Continuation of Ser. No. 351,997, Feb. 24, 1982, Pat. No. 4,495,972, which is a continuation-in-part of Ser. No. 236,583, Feb. 20, 1981, abandoned, and a continuation-in-part of Ser. No. 236,584, Feb. 20, 1981, abandoned.

[30] Foreign Application Priority Data

| | | | |
|---|---|---|---|
| Feb. 27, 1980 | [GB] | United Kingdom | 8006529 |
| Feb. 26, 1981 | [GB] | United Kingdom | 8106130 |
| Sep. 21, 1981 | [GB] | United Kingdom | 8128479 |

[51] Int. Cl.[4] ..... B21F 09/02

[52] U.S. Cl. ..... 140/93 A; 140/93.2; 24/16 PB

[58] Field of Search ..... 140/57, 93 A, 93.2, 140/123.6; 100/33 PB; 206/343; 24/16 PB

[56] References Cited

U.S. PATENT DOCUMENTS

| | | | |
|---|---|---|---|
| 3,164,250 | 1/1965 | Paxton | 206/343 |
| 3,484,905 | 12/1969 | Eberhardt | 24/16 PB |
| 4,359,070 | 11/1982 | Hidassy et al. | 140/93.2 |

*Primary Examiner*—Lowell A. Larson

*Attorney, Agent, or Firm*—Lockwood, Alex, FitzGibbon & Cummings

[57] ABSTRACT

A tie gun for applying a flexible tie around a roll or bundle, said tie having an apertured head through which the tail of the tie, after looping around the roll or bundle, is threaded, tensioned and locked in position, the gun incorporating an indexing means in the form of a rotary drum which advances successive ties, tail forward, into the path of a push rod driven by a trigger actuated, pneumatically operated piston so that said push rod performs a rearward stroke during the second part of an operating cycle and in so doing indexes the tie feed drum and simultaneously turns the buckle of an advanced tie into a tail receiving position, thus completing loading of the gun in readiness for the next operating cycle during the first part of which the push rod moves forwardly to push the tail around the roll or bundle to be tied back through the pre-orientated buckle ready for tensioning and locking.

4 Claims, 44 Drawing Figures

FIG.9.
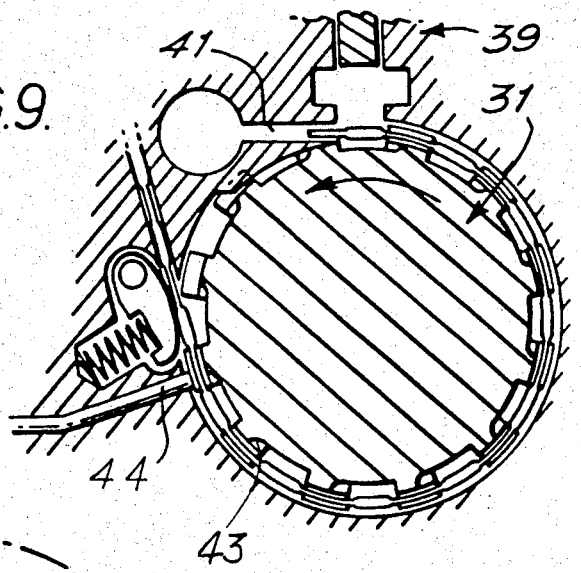
FIG.10.
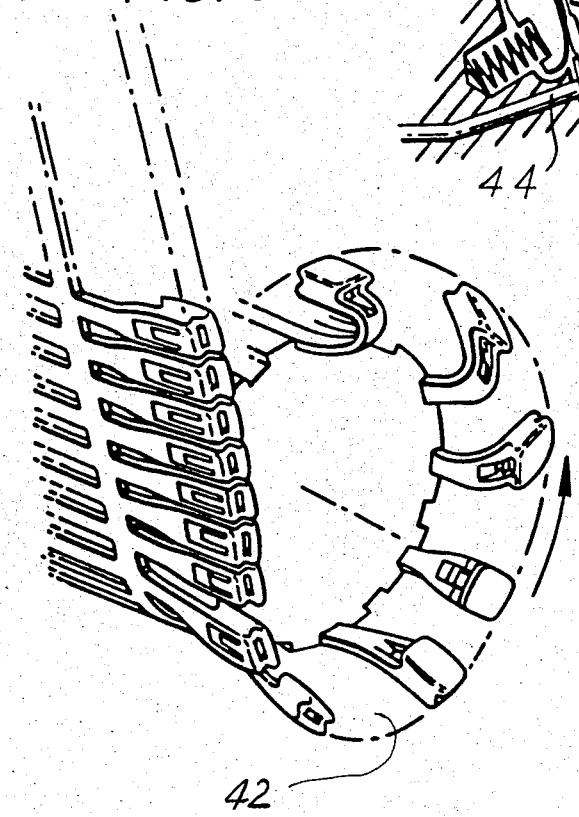
FIG.11a.
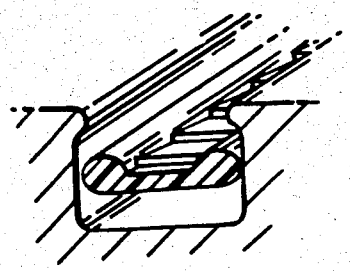
FIG.11b.
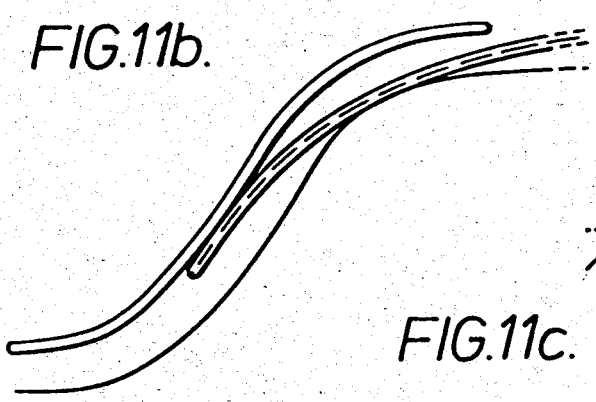
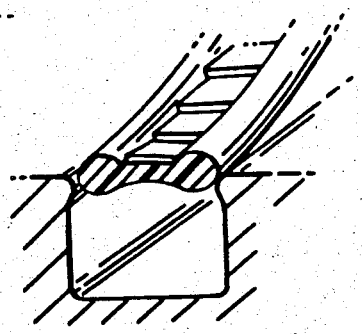
FIG.11c.

FIG.16a.
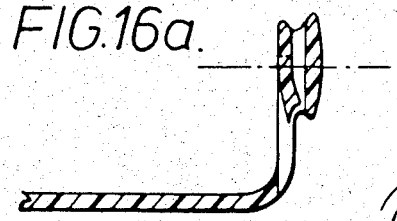
FIG.16b.
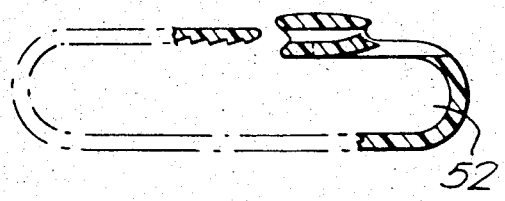
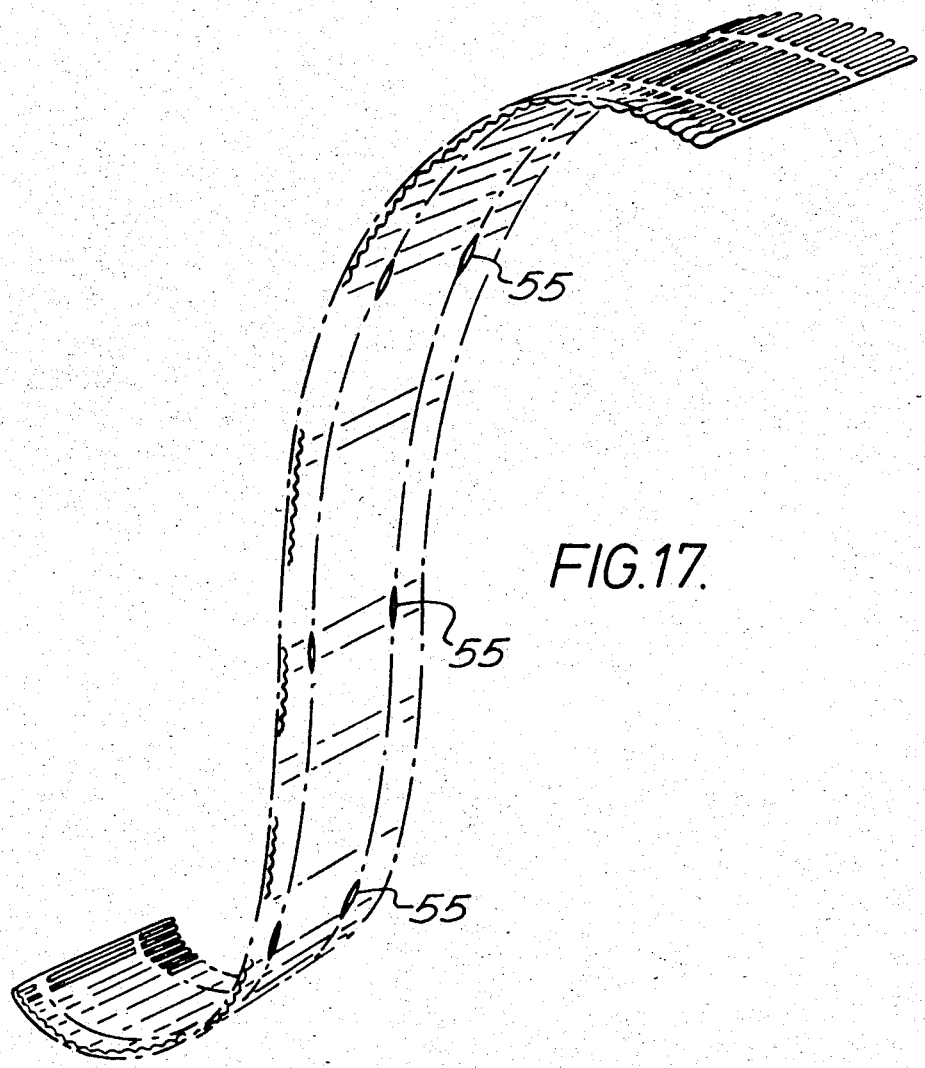
FIG.17.

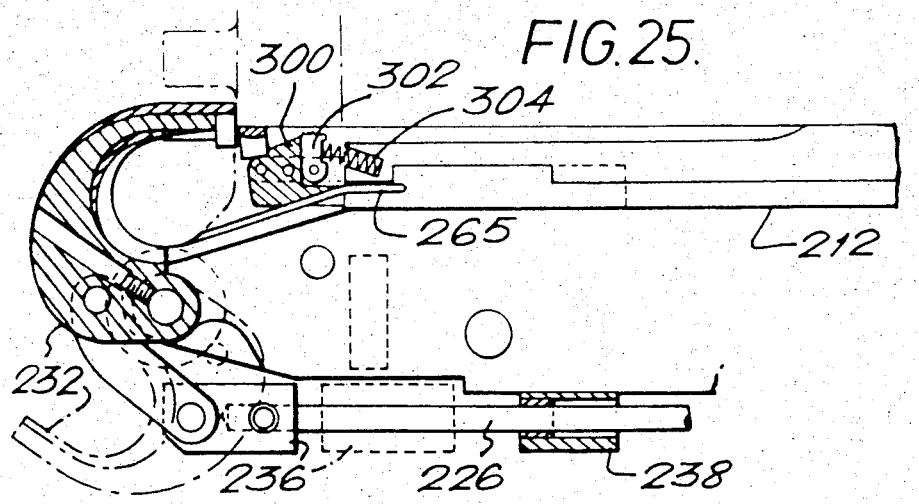
FIG. 25.
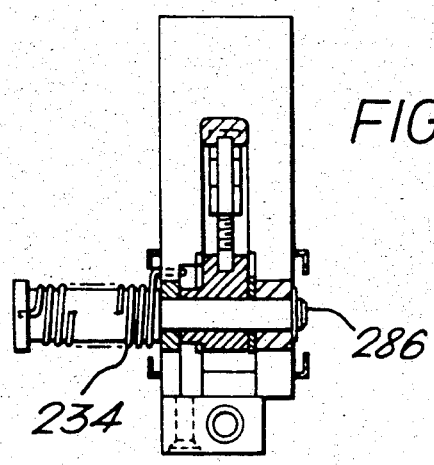
FIG. 25A.
FIG. 26.
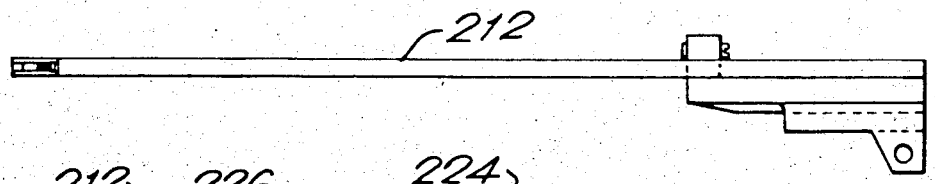
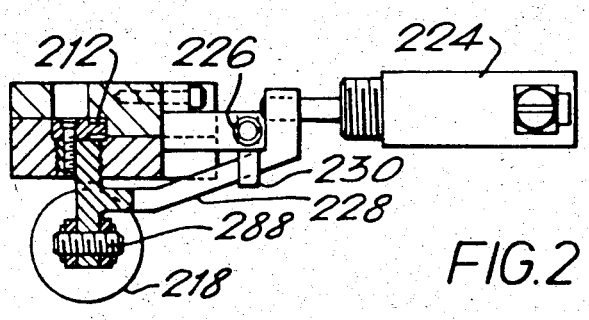
FIG. 27.

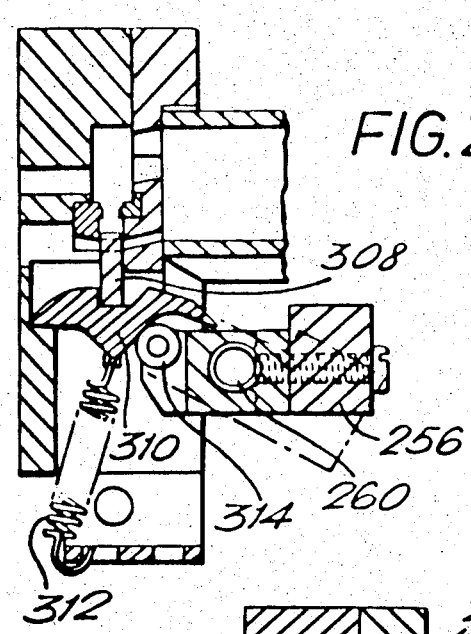
FIG. 28A.
FIG. 28.
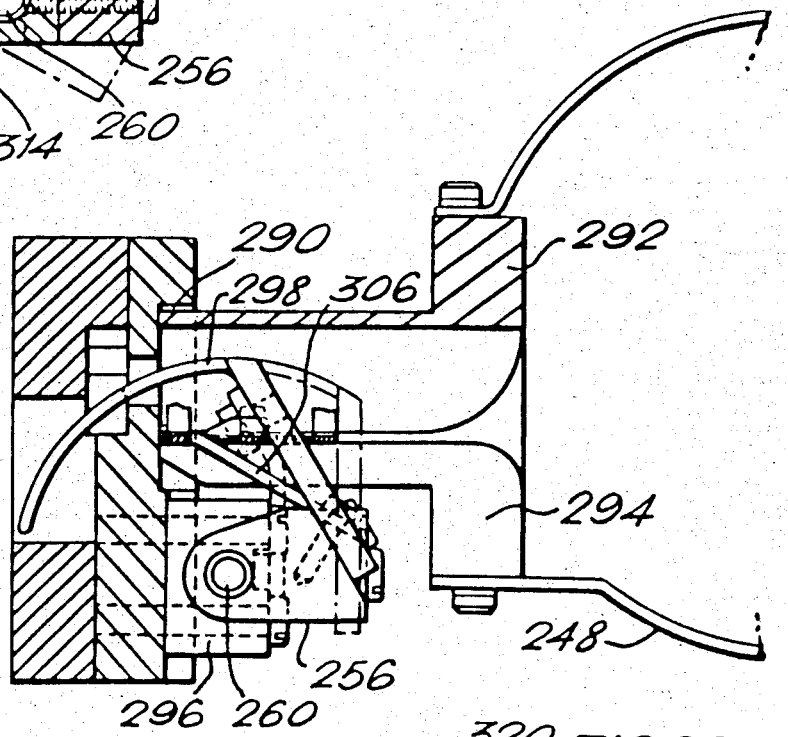
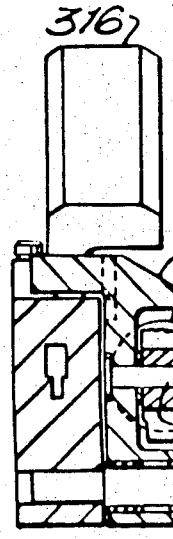
FIG. 29B.
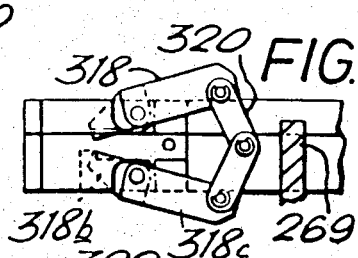
FIG. 29.
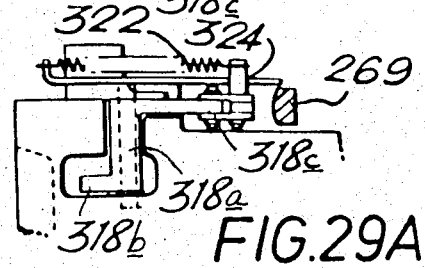
FIG. 29A.

AUTOMATIC TIE GUN

RELATED APPLICATIONS

This application is a continuation of application Ser. No. 351,997, filed Feb. 24, 1982, now U.S. Pat. No. 4,495,972 granted Jan. 29, 1985, which is a continuation-in-part of application Ser. No. 236,583 and application Ser. No. 236,584, both of which were field Feb. 20, 1981, and which are now abandoned.

This invention relates to the automatic application of ties.

It is often necessary to tie bundles of elongate objects together, for example bundles of cables or wires which if left unbound might present a hazard as well as being unsightly. One way in which cables are often bound together is by flexible plastic ties which have an integral fastener, or buckle, at one end through which the tail end of the tie is threaded once it has been passed around the bundle of cables. Manual application of the ties is slow and laborious, and it is therefore desirable to have a tool which automatically performs the binding operation.

A gun for automatically applying ties has been designed in which a pair of jaws can be closed around a bundle of cables, and a flexible tie pushed forwards by a plunger so that the tail is pushed around the loop defined by the jaws and through an apertured buckle at the other end of the tie. The tail is then pulled tight, twisted by 90° with respect to the buckle to lock it in place, and the excess length cut off. Ties are supplied singly to this gun from a pre-loaded magazine which is mounted on the exterior of the gun. Some of the disadvantages of such a gun stem from the type of tie which is used; the "twist and lock" type of tie has to be over-tensioned then relaxed back before it locks, which does not always provide satisfactory tensioning, also the fastened tie has a knobby finish at the buckle, which is apertured so that the tail of the tie is threaded at approximately right angles to the longitudinal direction of the tie adjacent the fastener. Furthermore the gun is made in a sealed unit which is heavy, bulky and cannot be readily serviced.

Another gun has been proposed in which ties are conveyed one at a time from a magazine mounted remote from the gun, but is otherwise similar to that previously described. A third machine uses separate buckles and a continuous spool of tape. Neither of these machines has proved consistently reliable in use.

The present invention is directed towards a tie gun which may provide a reliable tie feed mechanism, which may be readily serviced, and which may incorporate standard replaceable components.

Tie applying tools or guns provided in accordance with this invention, and to be described herein, utilise a belt or bandolier of ties connected in parallel arrangement by integral bridging pieces, and preferably fed into the gun from a replaceable magazine in which the bandolier is coiled. The buckle or head of the tie may comprise a longitudinal aperture through which the tail of the tie is to be threaded, so that once threaded the tail overlies the portion of tie adjacent the buckle.

Alternatively, the aperture may extend through the buckle transverse to the plane of the tie. In both embodiments of the gun, the buckle portion of the tie is disposed at an appropriate orientation (relative to the remainder of the tie) prior to the tie being pushed tail-first from the gun and around the bundle or roll to be tied, said buckle orientation being such as to ensure that the tail will be directed through the buckle aperture after said tail has been guided around the bundle and back towards the gun. In the type of tie with longitudinal buckle aperture, this orientation is approximately 180° relative to the remainder of the tie, and in the type of tie with transverse buckle aperture, the orientation is approximately 90° relative to the remainder of the tie.

Embodiments of the invention will now be described, by way of examples only, with reference to the accompanying drawings, in which.

Figures 1, 1A:
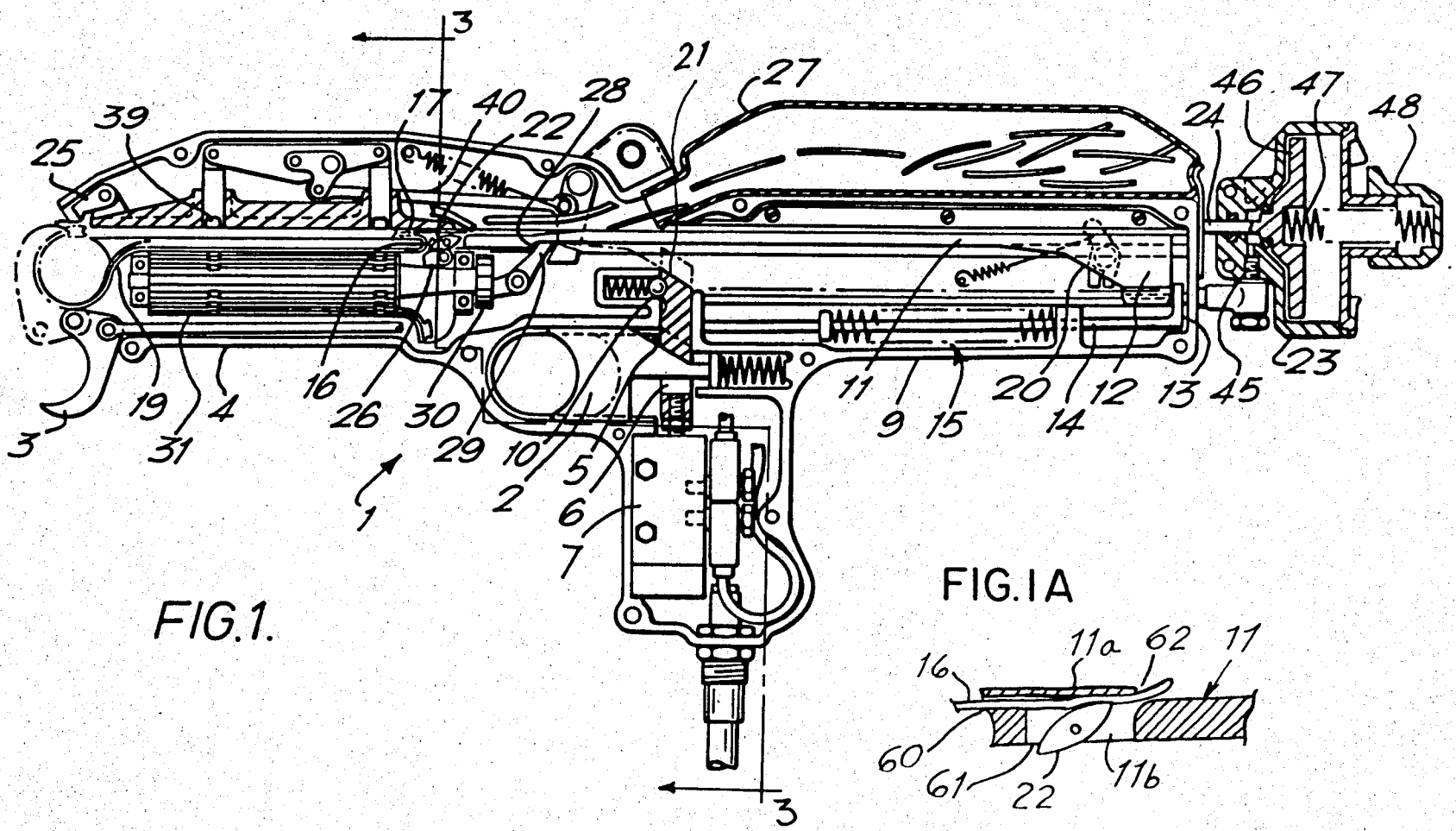
FIG. 1 is a section through an embodiment of the invention in the form of a tie gun.
Figure 1B:
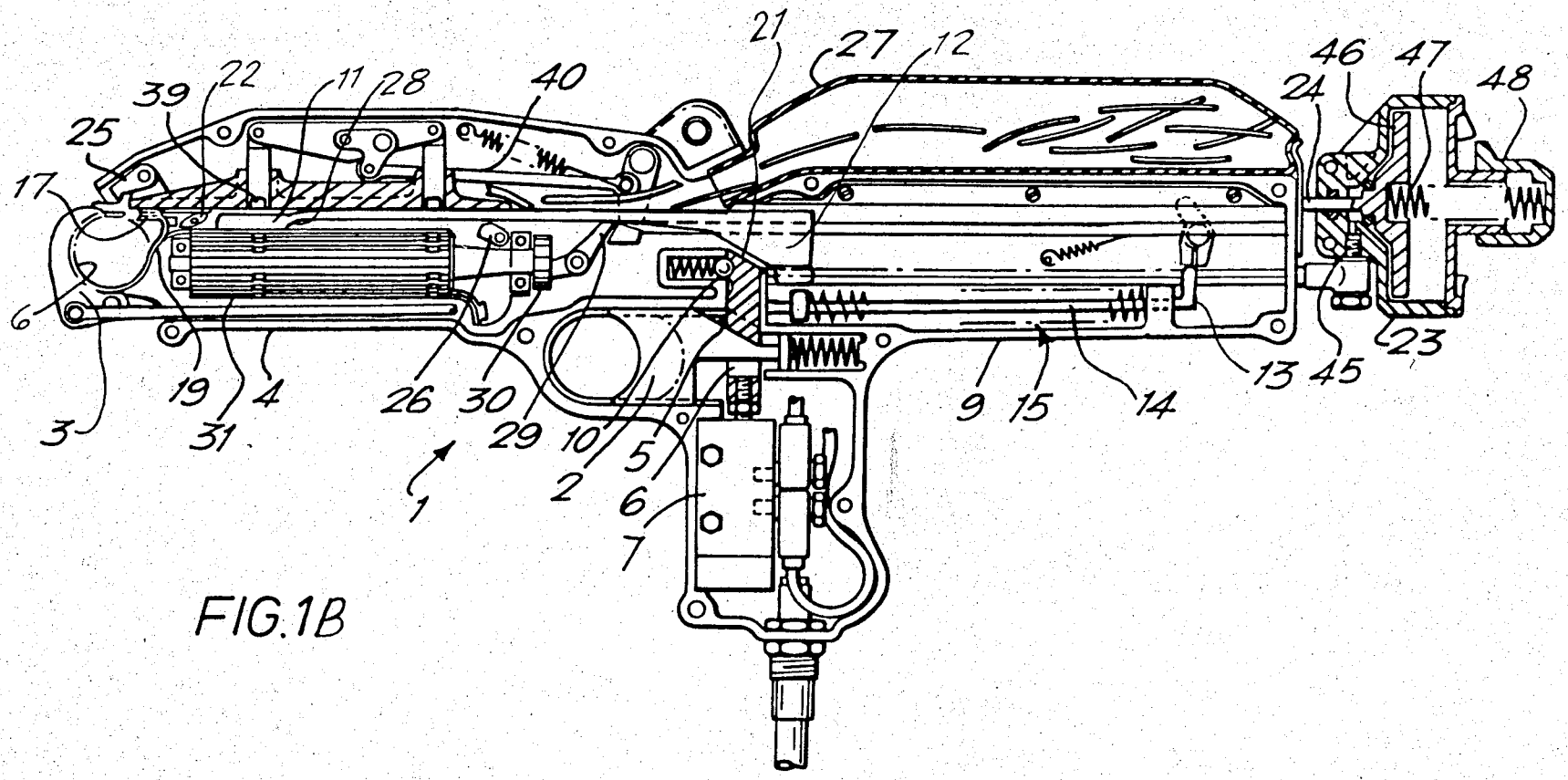
Figure 7:
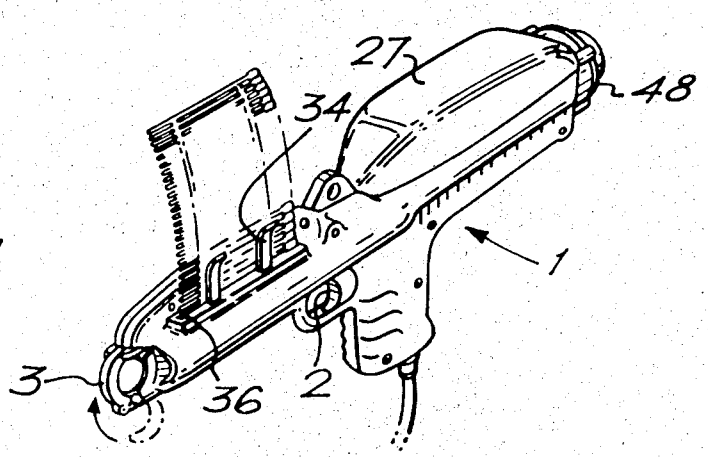
Figure 5:
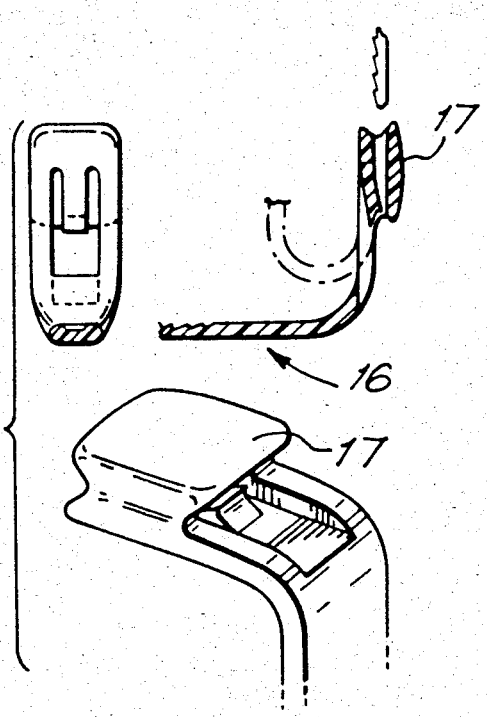
FIG. 5 shows a preferred type of flexible tie for the gun of FIG. 1.
Figure 6A:
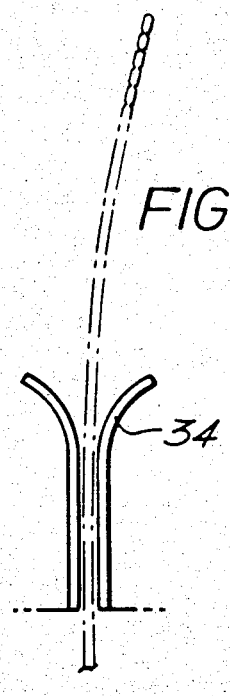
Figure 6B:
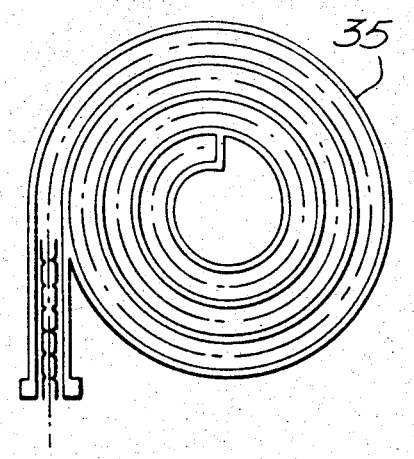
Figure 8A:
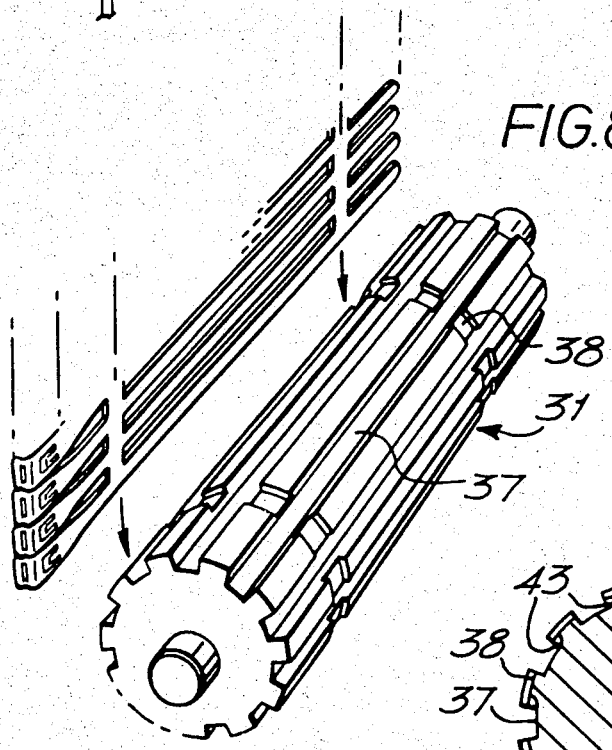
Figure 8B:
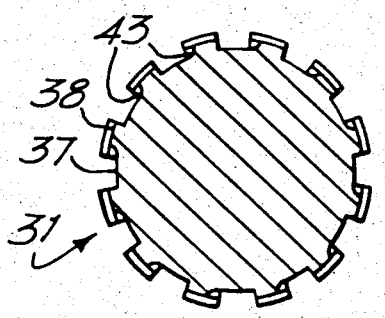
Figure 12:
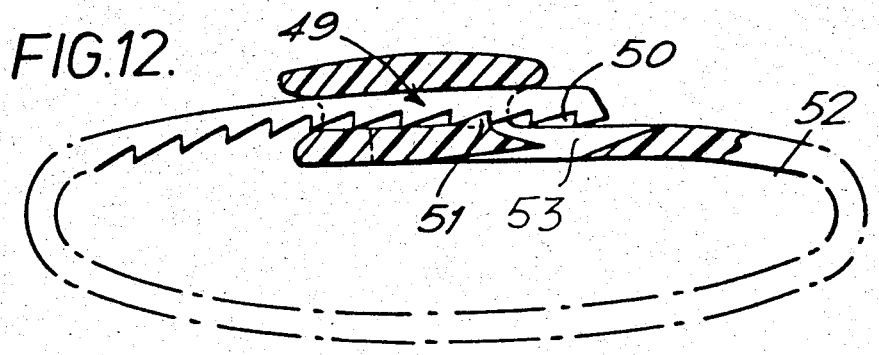
Figure 13:
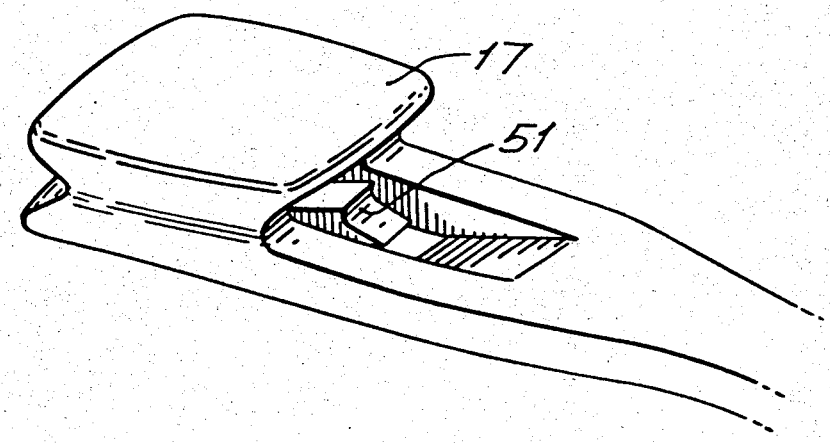
Figure 14:
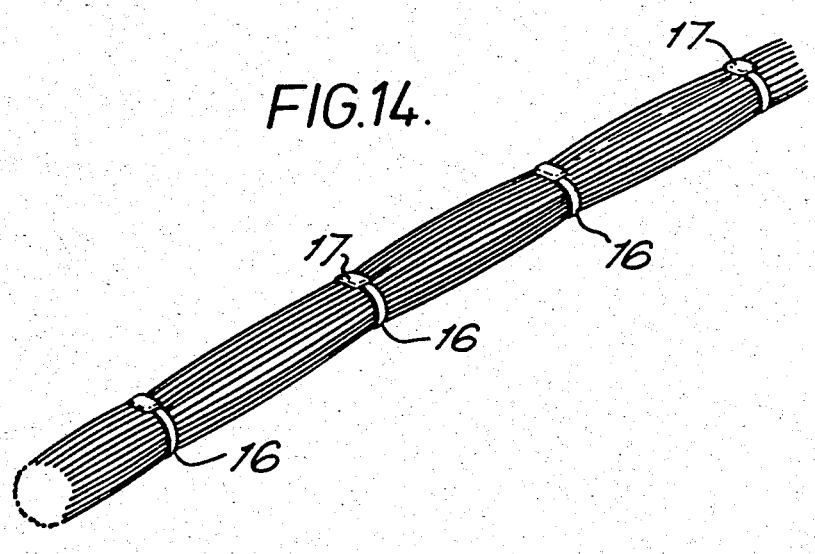
Figure 15A:
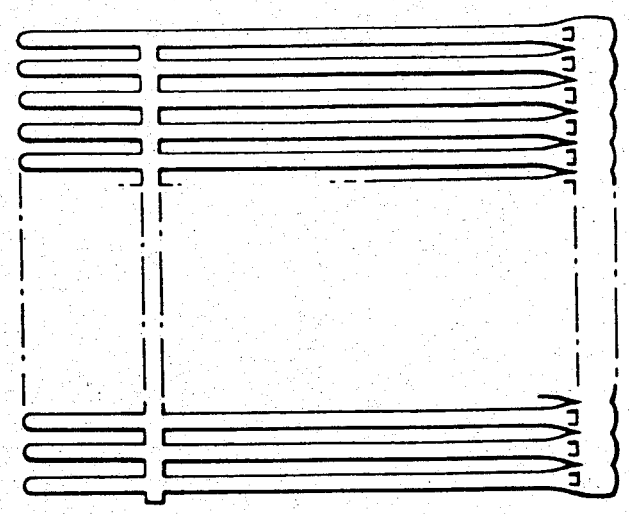
Figure 15B:
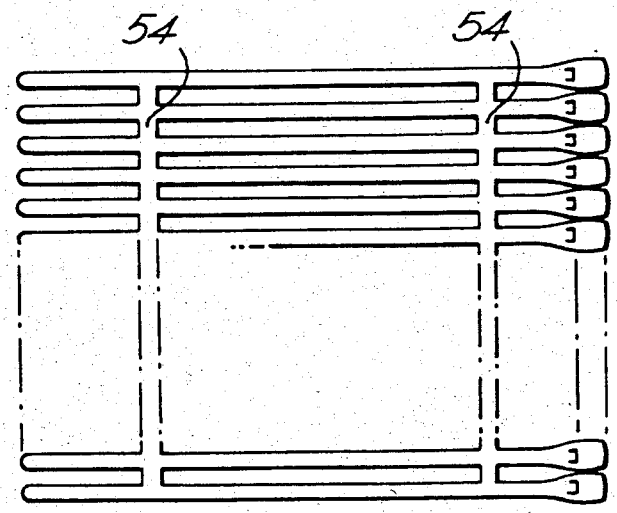
Figure 18A:
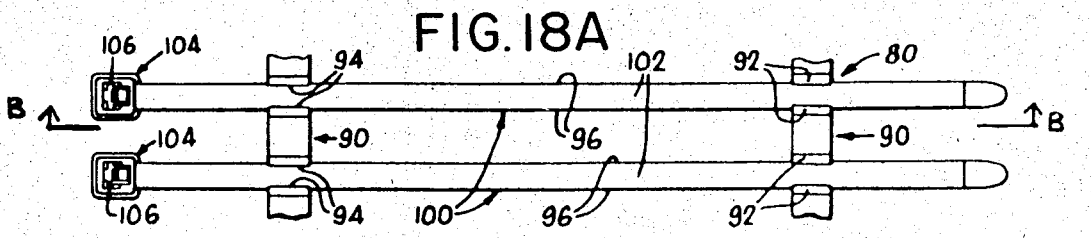
Figure 18B:
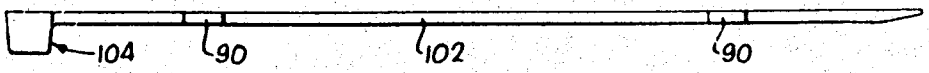
Figure 20:
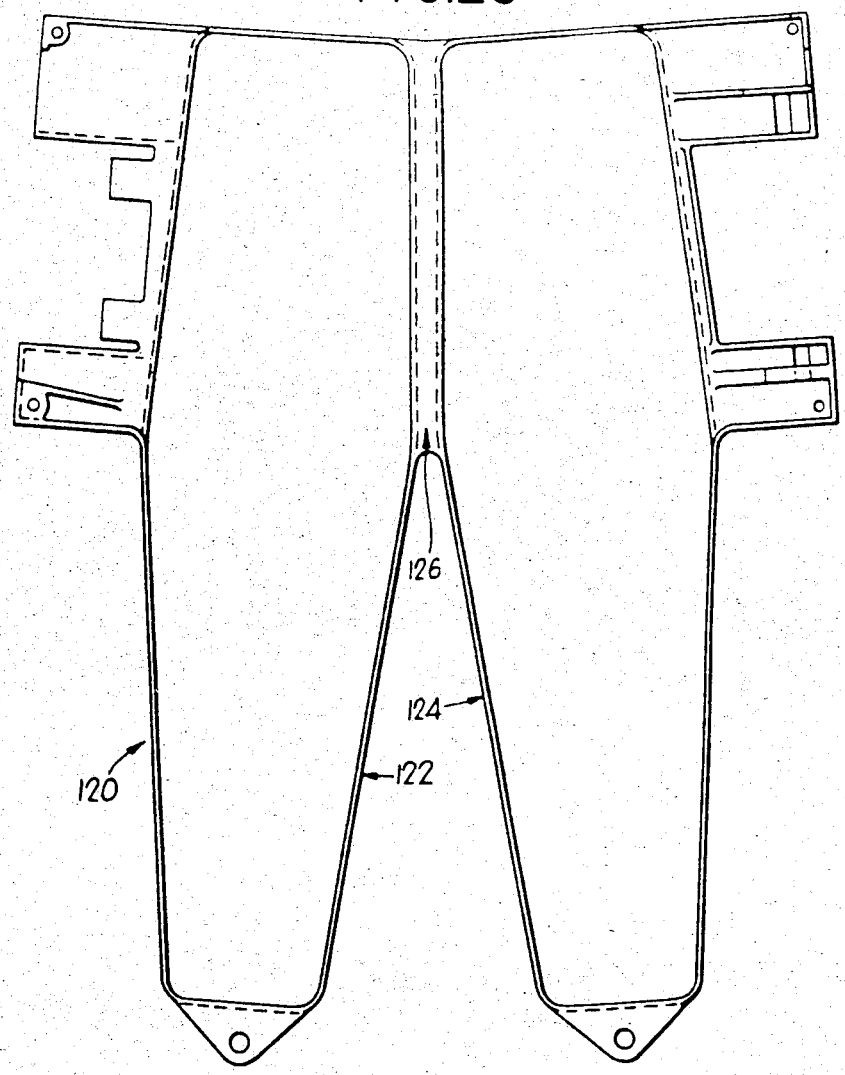
Figure 21:
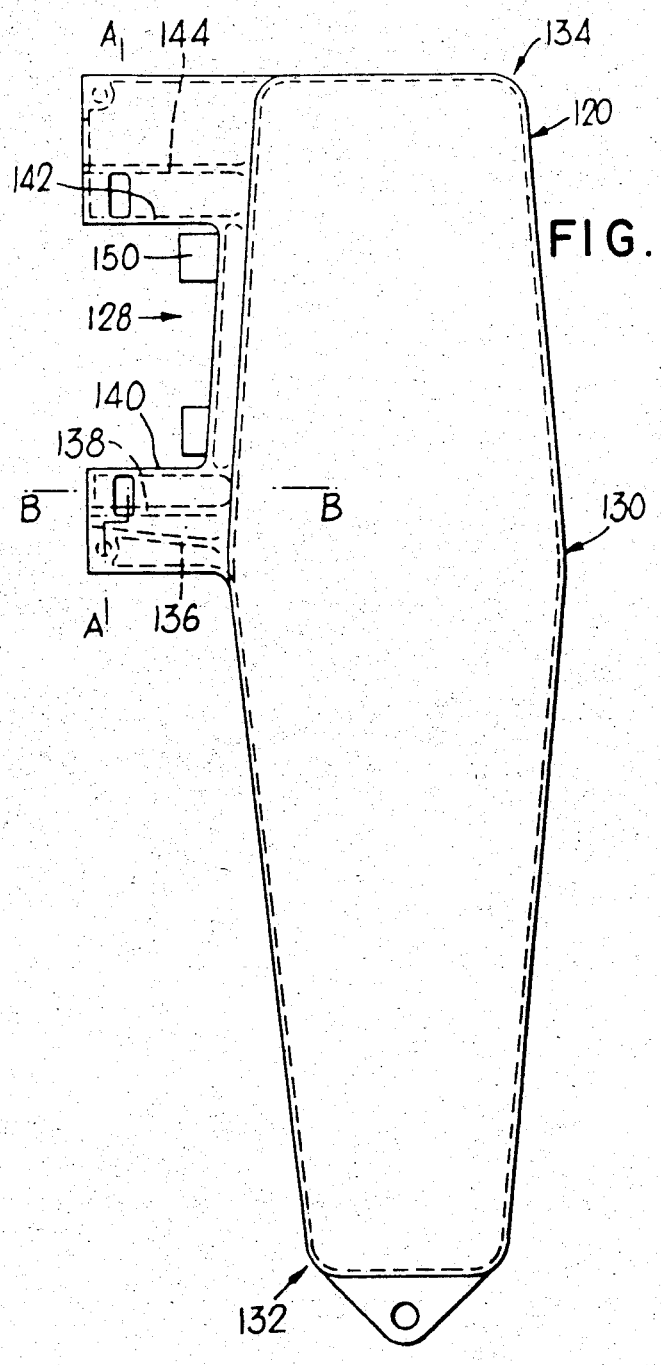
Figure 22A:
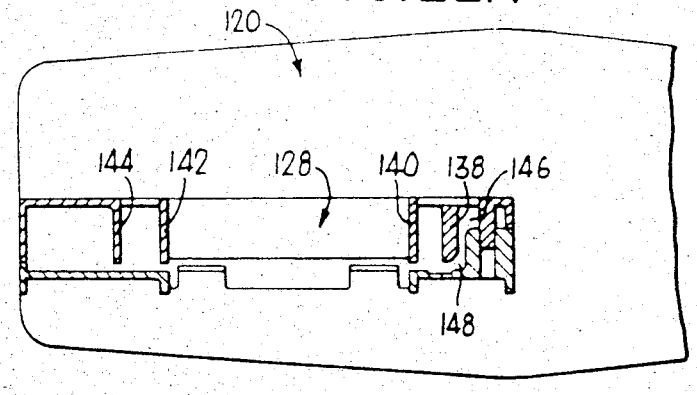
Figure 22B:
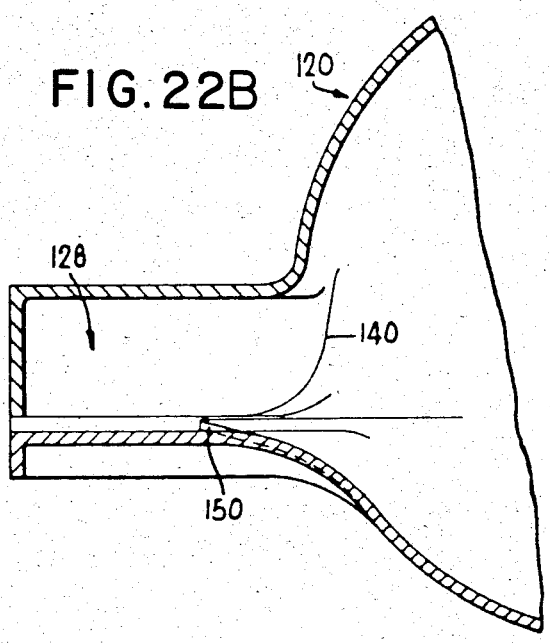
Figure 23:
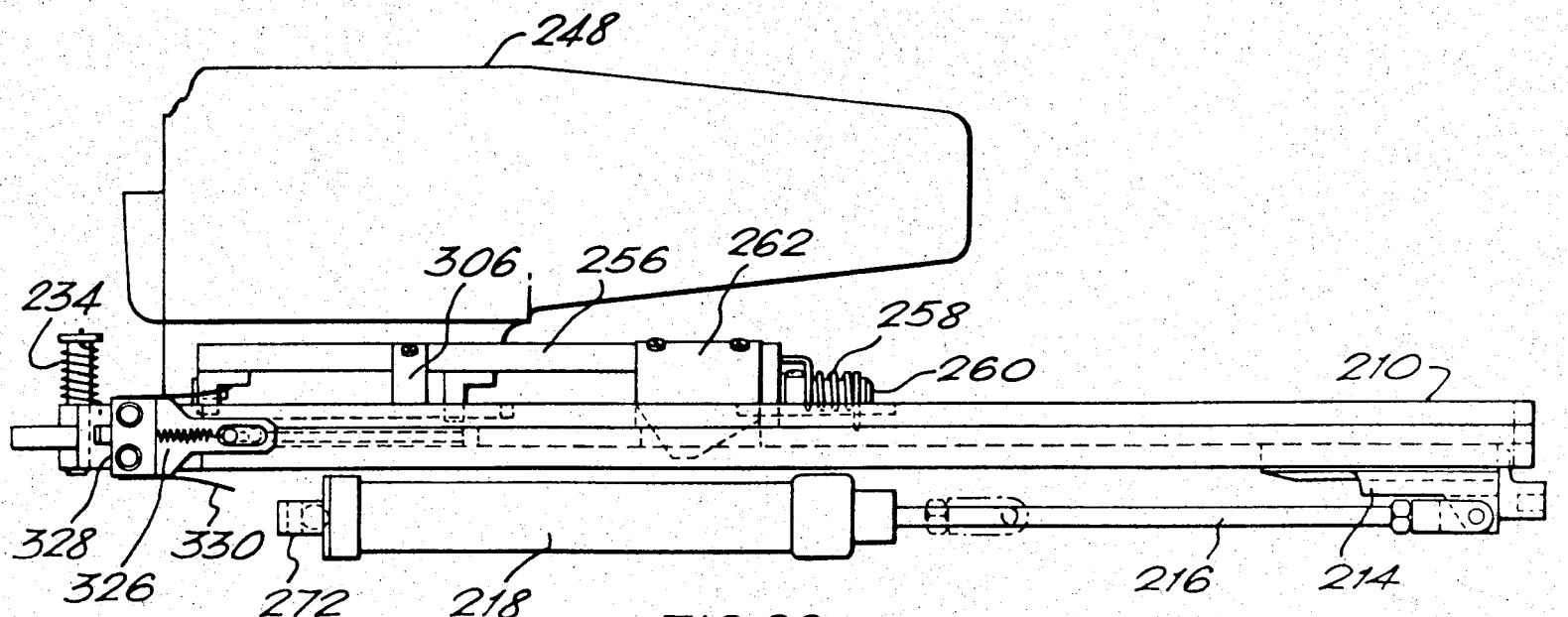
Figure 24:
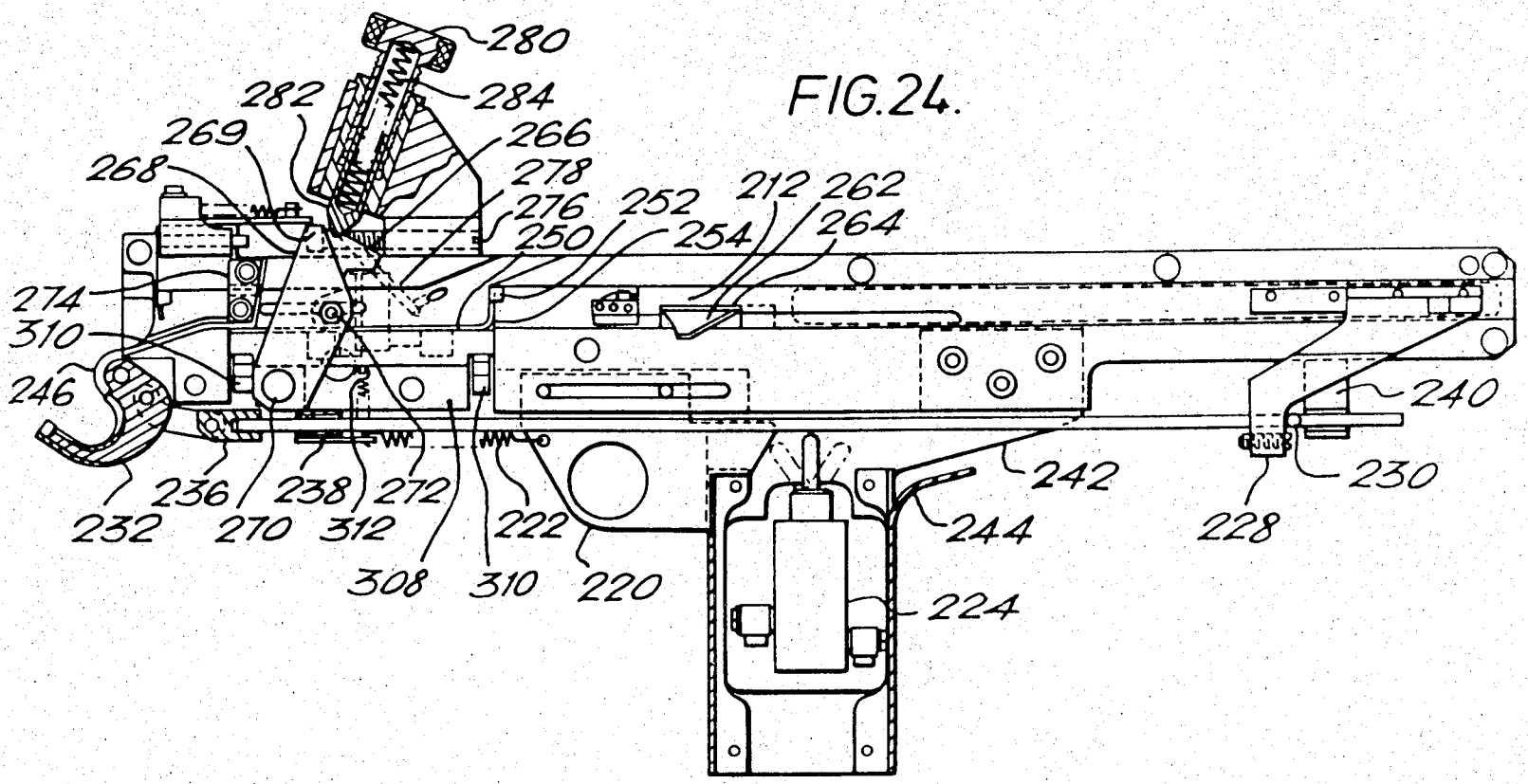

FIGS. 6*a* and 6*b* show two alternative embodiments of support for a belt of flexible ties;

FIG. 7 is a front perspective view of the tie gun of FIG. 1;

FIGS. 8*a* and 8*b* are perspective and cross-sectional views of a preferred form of drum used in the gun of FIG. 1;

FIG. 9 shows a preferred mechanism for disconnecting the ties from the adjacent ties;

FIG. 10 illustrates a volute by which in the FIG. 1 embodiment the ties are positioned;

FIGS. 11*a*, 11*b* and 11*c* show a lipped slot, along which in the FIG. 1 embodiment, the tie is diverted;

FIG. 12 shows a section through the tie of FIG. 5 when threaded;

FIG. 13 is a perspective view of the buckle of the tie;

FIG. 14 illustrates a bundle of cables bound by flexible ties;

FIG. 15 illustrates a belt of flexible ties, FIG. 15*b* showing a preferred form of belt for use in conjunction with the tie gun of FIG. 1;

FIGS. 16*a* and 16*b* are sectional views through a flexible tie;

FIG. 17 illustrates an elongated belt of ties comprising several shorter belts joined together;

FIG. 18*a* shows a small part of the length of a bandolier according to an alternative preferred embodiment and FIG. 18*b* is a sectional view thereof;

FIGS. 19*a* to 19*d* show details of the tie in the preferred embodiment of FIG. 18;

FIG. 20 shows the interior of an opened magazine for the bandolier of FIG. 18;

FIG. 21 shows the closed magazine;

FIGS. 22*a* and 22*b* are sectional views on the lines A—A and B—B of FIG. 21;

FIG. 23 is a plan view of a second embodiment of tie gun, for use with the bandolier and magazine of FIGS. 18 to 22;

FIG. 24 is an elevational view inside a side wall of the gun of FIG. 23;

FIGS. 25 and 25A show to an enlarged scale details at the front end of the gun of FIG. 23, including a nose loop assembly;

FIG. 26 shows the construction of a pusher rod in the gun of FIG. 23;

FIG. 27 shows detail of a changeover valve assembly in the gun of FIG. 23;

FIGS. 28 and 28*a* show details of an entrance region of the gun of FIG. 23, at which entrance ties are fed in from a magazine, and also showing a tie-indexing assembly; and FIGS. 29, 29*a* and 29*b* show details associated with a tie-cutting assembly of the gun of FIG. 23.

The tie gun illustrated in FIG. 1 is particularly adapted for binding cables together with flexible ties, the fastenings of which have a low profile when secured around the cable bundle. Operation of the gun is controlled by a pneumatic cylinder and the various stages in the operating cycle are indexed to the stroke of the piston of the cylinder. In the following description before the detailed construction of the gun is described, the general sequence of its operation is outlined along with a brief description of the tie and the feed mechanism. Then the operating sequence is explained in more detail with reference to the drawings, and this is followed by a detailed description of the construction of the various units of the gun which perform specific functions which are referred to in the operating sequence, and also by a more detailed description of the flexible ties used in the gun.

Briefly, the operating sequence of the gun is governed by the piston of the pneumatic control cylinder which is linked to a ram so that during the inward and outward strokes of the piston, flanges on the ram engage with and activate other parts of the mechanism. The piston is activated to move inwardly by depression of a trigger, whereupon a guide loop is closed about the bundle of cables which are to be bound and the tip of a flexible tie is pushed forward so that it passes around the cable via the guide loop and is threaded through a fastener on the other end of the tie. Once the tie is threaded the piston commences its outward stroke and the tip of the tie is gripped, the tie pulled tight, and, once a predetermined tension is reached, the excess length of tie is trimmed off. Then, whilst the piston completes its outward stroke, another tie is advanced to the firing position, the scrap trim is ejected and the guide loop is released from the bound cable.

The feed mechanism by which the ties are advanced includes a cylindrical drum with longitudinal recesses which accommodate the tails of the ties as they are fed into the gun from one side of the drum. The ties are advanced by rotation of the drum during the latter part of each outward stroke of the piston which brings successive ties to the topmost position ready for subsequent firing. In order to simplify the indexing of the ties into their respective recesses, in the correct orientation, the ties are joined together by bridging pieces to form a belt. Once a tie is in the firing position it is cut free from its bridging pieces by a cropping mechanism.

In order to achieve a low profile fastening, a tie was designed in which the tail threads through a longitudinal aperture in the buckle so that the threaded portion lies along the portion of the tie adjacent to the buckle rather than projecting perpendicular to it. To thread this type of tie the buckle needs to be rotated through 180° (compared with when the tie is laid flat) to receive the tail which has been passed around the bundle of cables. Therefore, in addition to advancing successive ties to the firing position, the feed mechansim of the gun also rotates the buckle to the correct orientation for receiving the tail. This is achieved by the buckles of the ties, which overhang the rearward edge of the drum, abutting a volute which causes the buckle portion of the tie to be progressively bent outward and then back on itself as the drum is rotated, so that the 180° rotation has been completed by the time the tie is in the firing position.

Figure 2:
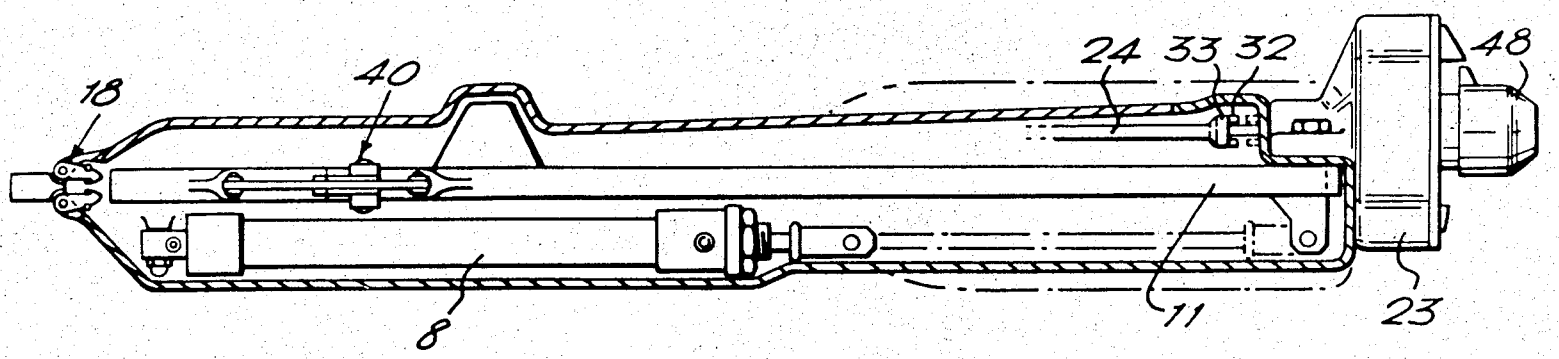
FIG. 2 is a plan view from above of the tie gun of FIG. 1.
Figure 3:
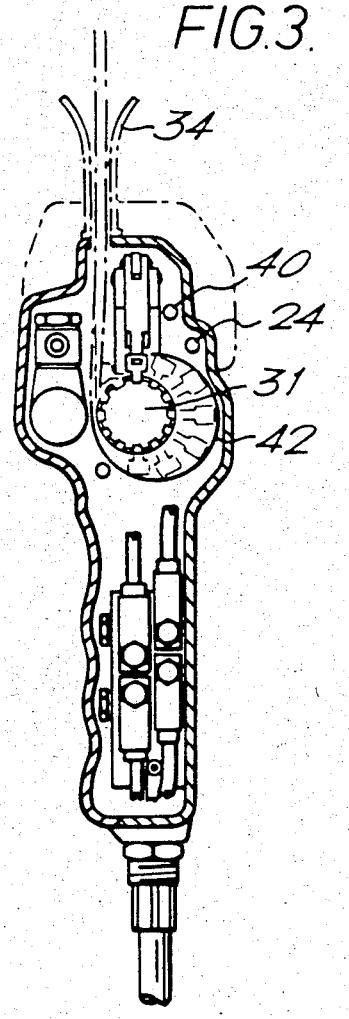
FIG. 3 is a view in the direction of arrows A—A of the gun of FIG. 1.

Referring now to FIG. 1, the tie gun is shown generally as 1, and has a spring return trigger 2. A guide loop 3 is provided at the end of barrel 4 of the gun, and can be closed about a suitable bundle of cables close to which the end of the barrel 4 has been placed. Trigger 2 is provided with an inclined surface 5 which abuts an inclined surface on the spool 6 of a valve 7 so that upon a depression of the trigger the spool 6 is lifted and air is provided to one end of a pneumatic cylinder 8 which, as may be seen from FIGS. 2 and 3, is disposed in the barrel 4 of the gun with its piston rod free to extend into rear portion 9 of the gun 1. Spool 6 is held in its lifted position by detent 10 and the extended piston of the pneumatic cylinder retracts moving a ram 11, which is connected to the piston, to the left as viewed. Ram 11 is provided with a flange 12 at its end remote from the barrel which abuts a flange 13 on a biased rod 14, so that as flange 13 moves leftwards it permits rod 14 to move left under the influence of spring 15, which closes guide loop 3. The barrel end of ram 11 acts as a pusher for a tie 16 and as it advances pushes the buckle 17 of a tie 16 into a pair of spring loaded jaws 18, which are mounted on the forward end of the barrel of the tool, the tail end of the tie being pushed down a lipped slot 19, around the guide loop 3 and through the buckle. Ram 11 is now in its most leftward position, and the piston is fully retracted. In this position an inclined surface 20 on flange 12 has engaged with a corresponding upper inclined surface 21 on spool 6 and pushed down the spool, which is then retained in its down position by detent 10, which causes the action of the pneumatic cylinder 8 to be reversed.

Figure 4:
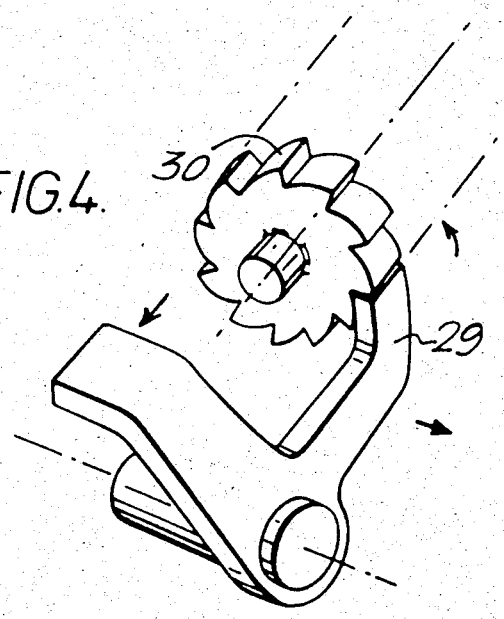
FIG. 4 is a view of the ratchet mechanism which rotates the drum of FIG. 1.

On the outward stroke of the piston the tail of tie 16, which is gripped by a clamp 22, is pulled, the buckle being retained by jaws 18 until a predetermined tension is sensed by a cut-off unit 23, whereupon a rod 24 is moved to the right causing knife 25 to sever the tail of the tie 16 close to the buckle 17. The release of tension caused by cutting the tail resets the cut-off unit which retracts the knife 25, and also causes the piston to continue to extend at an increased speed. A scrap release trigger 26 which is spring loaded upwards but depressed during the passage of the ram rod 11 over it, is then released as it is cleared by the end of ram 11, and this trigger then engages clamp 22 so that the tail is released, the tail being impelled into scrap bottle 27 partly under its own momentum and partly by pneumatic ejection. A projection 28 on ram rod 11 engages a bell crank 29 to advance a feed ratchet 30 which rotates drum 31 and aligns a new tie with the end of the ram 11 ready for the next cycle. FIG. 4 shows the feed ratchet 30 and bell crank 29 in detail. Bell crank 29 is sprung so that it can move to the next ratchet position, when it is released on the inward stroke of the piston, ready to rotate the drum 31 during the subsequent outward stroke. Precise positioning of the drum may be achieved by a rotation detent in which a sprung member indexes with notches in the drum once it has been rotated by the bell crank and ratchet. Whilst the outward stroke of the piston continues further, a flange on the ram rod 11 engages with a forked lever 32, the other end of which engages a flange 33 on cut-off rod 24 to ensure that the cut-off unit is properly reset, and finally, flange 12 of ram rod 11 pushes flange 13 to the right which opens the guide loop 3 and releases the bound cable.

FIG. 5 shows the construction of a suitable low profile buckle with the threaded portion of the tail lying parallel to the end of the tie adjoining the buckle. The ties, which may be made of injection moulded plastics, are fully described hereinafter with reference to FIGS. 12 to 17. FIGS. 6*a* and 6*b* show two alternative forms of support for a belt of ties, in the simplest case one or more pairs of curved supports 34 are used, or, if it is undesirable to have the belt left waving, a magazine 35 in which the belt can be coiled is used. The belt of ties is fed into the gun 1 via a slot 36 which can be seen in the front perspective view of the gun in FIG. 7. Having passed through the slot the belt passes around drum 31 which is recessed as shown in FIG. 8 with longitudinal grooves 37 for the ties and circumferential grooves 38 for the bridging pieces between the ties. Longitudinal grooves 37 are deeper than circumferential grooves 38 so that the ties are supported on the drum 31, by the bridging pieces, above the base of the longitudinal grooves 37. The longitudinal grooves may also serve, at one end, as the notches into which the sprung member of the rotation detent indexes. Wen a tie has passed around the drum 31 and is aligned with the ram rod 11, it is cut free from its bridging pieces by reciprocating action of crops 39, which are actuated via lever linkage 40 and projection 28 on ram 11 during the outward stroke of the piston in the cycle of operation of tying the immediately preceding tie. FIG. 9 schematically shows the action of crops 39; the action is synchronised to take place immediately after the tie has been rotated into position by feed ratchet 30, both the feed ratchet 30 and the crops 39 being activated by projection 28. The scrap bridging pieces drop into a waste chute 41 and are exhausted into waste bottle 27.

Whilst drum 31 is progressively rotated, the buckle end of the ties are gradually bent over by a voluted surface 42, as shown in FIG. 10, so that the buckle is eventually bent through 180° with respect to the tail. Depression of trigger 2 causes the tie to be advanced in this bent over condition by the advancing ram 11, the buckle engaging with buckle clasp 18, and the tip being directed down the S-bend of lipped slot 19, around the cable and through the buckle. The lips of slot 19, shown in FIG. 11*a*, retain the tie within the slot during its passage down the S-bend (FIG. 11*b*), but once the tensioning operation commences the tie can be pulled free as shown in FIG. 11*c*.

Drum 31 is provided with cutaway apertures 43 in the circumferential groove 38, each of these being arranged so as to be covered by the bridging pieces of the belt of ties (see FIG. 8) when there is a tie in the respective preceding slot 36. An airline 44 has an open end located such that after the last tie of a belt of ties feeding into the gun has been engaged, and the drum is rotated to the next position where it would otherwise have engaged the next tie, air from airline 44 passes through the uncovered aperture 43 and causes a whistle indicating that a new belt of ties is required.

The cut-off unit 23 is shown in FIG. 1; for clarity it is illustrated displaced rearward from its correct position whilst FIG. 2 shows the cut-off unit correctly positioned. As a tie is tightened around a bundle of calbes, pressure in the pneumatic cylinder 8 rises in proportion to the tension in the tie. The cut-off unit is therefore responsive to the pressure in the pneumatic cylinder and can be adjusted such that the tightened tie is cut-off at a predetermined tie tension. A line 45 connects the cut-off unit to the pneumatic cylinder, so that the pressure applied to the left (as viewed) of a poppet 46 is equal to that driving the piston of the pneumatic cylinder 8. The poppert 46 is held in position by a spring 47, until the applied air pressure exceeds the pressure exerted by the spring 47, whereupon the poppet is unseated and moves to the right moving cut-off rod 24 and actuating knife 25. Release of the tie tension once the tail has been cut, and the drop in air pressure in the cut-off unit due to sudden expansion of air when the poppet is unseated, enables the poppet 46 to be pushed left again by spring 47. Meanwhile the piston of pneumatic cylinder 8, also relieved of the tension of the tie, completes its stroke and lever 32 engages flange 33 and ensures that the poppet 46 is reseated in its original position. Different tie tensions may be obtained by adjusting knob 48 which changes the compression in spring 47.

Referring to FIGS. 5, 12 and 13, the buckle 17 has a longitudinal aperture 49 through which the tail can be threaded so that ratchet serrations 50 on one surface of the tail engage with a pawl 51, which prevents the tail from being pulled back out of the aperture 49 but enables it to be advanced through to tighten the loop 52 formed by the tail. A slot 53 is provided beneath pawl 51 which enables it to be resiliently depressed by the serrations 50 for ease of advancement of the tail through the aperture 49.

FIG. 14 shows a bundle of cables bound by flexible ties illustrating the low profile fastening achieved by the flexible ties used in the tie gun. A low profile tie of this type may, as well as being visually appealing, be particularly advantageous for example when the bound cables are to be inserted through restricted apertures, or into confined spaces, such as may occur when fitting wired looms. In the drawings the tie is illustrated with serrations on the tail of the tie such that when the tie is threaded the serrations are on the inside of the loop. Although this configuration is often preferred because the serrations can also act to grip the cables or other items about which the tie is wound, the serrations may alternatively be formed so that they are on the outside of the loop, and in this case the pawl is formed extending down from the upper surface (as viewed) of the buckle 17.

The ties may be connected by integrally moulded bridging pieces as shown in FIG. 15*a*. However in order that the fasteners may be bent outwards by the voluted surface 42 without requiring previous separation, the ties are preferably fabricated, as shown in FIG. 15*b*, with the heads separate and the two bridging pieces 54 between the tails of adjacent ties. To ease the tooling requirements the belt of ties may be moulded with the tail bent through 90° near the buckle 17, as is shown in section in FIG. 16. These bent belts can be pressed flat for packing, and when used the preformed bend facilitates turning the buckle into the position shown in FIG. 16*b* for threading by the end of tail. In order to achieve a longer belt than can be conveniently moulded, individually moulded belts of say 20 ties may be connected by ultrasonic or thermal welding, into a continuous longer belt as shown in FIG. 17, of say 500 ties. to minimize jamming of the gun when used with such a continuous belt, joints 55 between the individually moulded belts should be made as smooth as possible.

The gun mechanism may be housed in a die-cast body, one half acting as a chassis onto which the component parts of the mechanism may be mounted, and the other half acting as a cover. A suitable type of pneumatic cylinder is a Martonair Midget M/6010 which has a 10 mm bore, 4 mm diameter rod and 130 mm stroke; a suitable type of valve is a Martonair M/1555/1.

Various modifications to the gun may be made, for example the feed mechanism may be modified so that the cylindrical drum can alternatively, or additionally, engage non-connected ties, which may be of use when the gun is not intended for intensive use.

FIG. 18*a* shows a part of a bandolier 80 of ties 100 of a different type. The bandolier 80 is itself generally the same as that previously described with reference to FIG. 17, however, the bridging pieces 90 connect to the tails 102 of the ties through grooves 92 defining lines of weakness or breakage 94 just inside the projected lines of the longitudinal edges 96 of the tails 102.

In use, the knife means in the gun act to apply a break-off pressure to the bridging pieces substantially in line with the longitudinal edge 96 of the tail 14, and causes the bridging pieces 52 to break off substantially along the lines 94. Thus, any defects or roughnesses along the breakage lines will not project laterally beyond the full width of the tail between its longitudinal edges, and will not interfere with operation of the gun, will not be liable to damage the roll or bundle during tightening of the tie therearound, and will not impair the general appearance and feel of the applied tie. FIG. 18*b* is a sectional view on the line B—B of FIG. 18*a*, from which is apparent the lesser thickness of the bridging pieces 90 as compared to that of the tails 102 of the ties 100.

The ties 100 differ from the ties 10 previously described in that the buckle consists of a head 104 apertured at 106 transversely to the length of the tie 100, i.e. normally to the plane of the drawing in FIG. 18*a*.

The tie 100 is intended for use in the tie gun of FIGS. 23–29 which acts to push the tie forwardly around a nose loop closed around the roll or bundle to be tired so that the tail 102 re-enters the barrel of the gun to be threaded through the aperture 106 in the buckle 104, the latter being orientated at right angles to the re-entrant tail. Thus, for enabling the tail 102 to be threaded through the buckle 104, the tie 100 when located in the gun is bent through 90 degrees adjacent the buckle, thus appropriately orientating the buckle aperture 106. The bending of the tie 100 can be achieved by preforming the tie with its head portion bent through the required 90°. Then if the tie is packed flat (e.g. in a magazine), on entering the gun the buckle springs into required orientation. Alternatively, a bending means may be incorporated in the gun, or as later described a bending means may be provided in the magazine from which the tie is supplied to the gun.

Figure 19C:
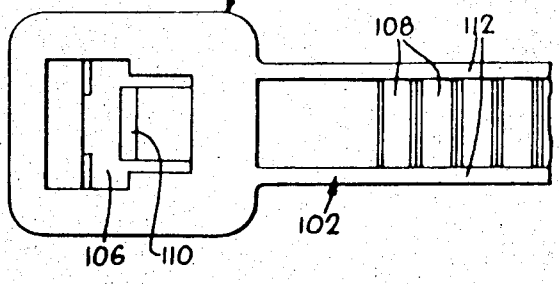
Figure 19D:
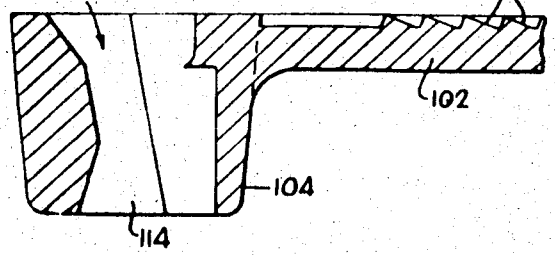
Figure 19A:
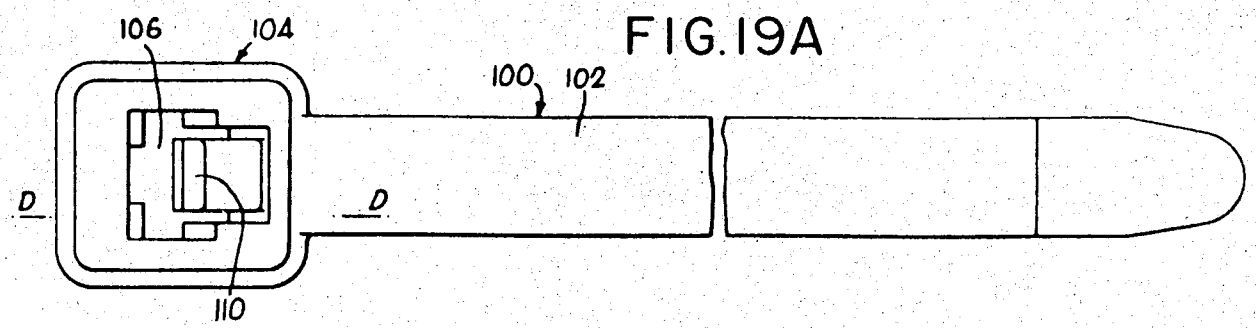
Figure 19B:
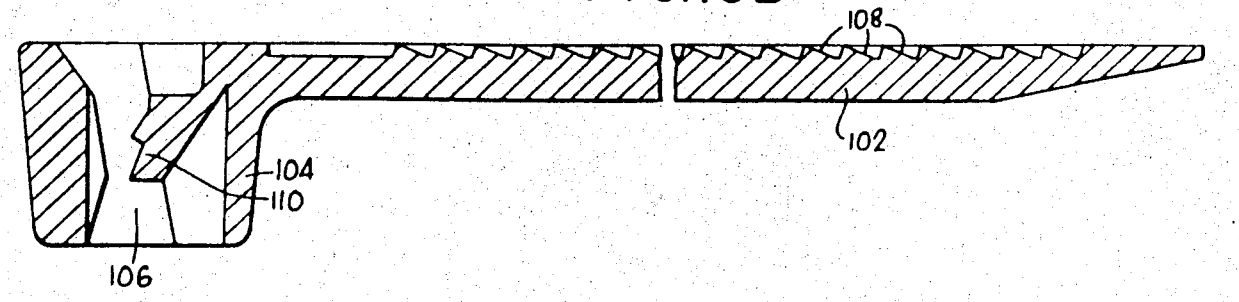

The construction of an individual tie 100 is shown in FIGS. 19*a* to 19*d*. FIG. 19*d* is a central longitudinal section through the tie and FIG. 19*d* is a section on line D—D of FIG. 19*a*. The tail 102 has serrations 108 which engage with a pawl 110 formed on the inside of the aperture 106 in the buckle or head 104, so that the serrated tail can be threaded and advanced through the buckle to tension the tie around the roll or bundle to to tied, whilst said tail once threaded cannot be pulled back through the buckle. It should be noted that as shown the serrations 108 are formed on the side of the tail 102 which will face inwardly of the loop around the roll or bundle being tied, but the converse arrangement can be used if desired. It will also be clear from the drawings that the tail 102 of the tie 100 has untoothed ribs 112 along its edges, which ribs are accommodated in clear portions 114 of the aperture 106 in the buckle 104 to the sides of the pawl 110.

FIGS. 20 to 22 show a magazine for housing the bandolier 80 of FIG. 18. The magazine 120 is formed of two parts 122, 124 hinged at 126, as indicated in FIG. 20, which shows the interior of the opened magazine when empty. The shaped elongate mouth of the magazine 120, formed when the two parts 122, 124 are closed together, is referenced 128 in FIG. 21.

The closed magazine 120 is generally of cylindrical form but with a maximum diameter at an intermediate position 130 in its length generally corresponding to the level of one end of the mouth 128. The magazine is shaped in this manner to receive a bandolier 80 of ties 100 which is coiled spirally, with the adjacent turns of buckles in juxtaposed but not overlapping relationship. Thus, when the magazine is full, the one end of the spiral coil formed by a turn of buckles is accommodated at the bottom end 132 of the magazine as shown in FIG. 21. As successive turns of buckles progressing up the coil are wound around an increasing number of tails, the diameter of the coil increases to a maximum at a level corresponding to the immediate position 130 along the magazine. This level is the level of the final turn of buckles, i.e. the outermost turn of the coil. The end of the bandolier 80 emerges through the mouth 128 from this final turn. The upper part of the coil progressing towards the top end 134 of the magazine is constituted by a reducing number of tails, so that the coil gradually reduces in diameter.

The mouth 128 of the magazine is adapted to preform a 90 degrees bend in the tie 100, adjacent the head, as the tie emerges from the magazine into a tie gun to which the magazine is adapted to attach. The purpose of such bend in the tie is to pre-orientate the buckle in the gun ready to receive the tail, as previously described. In order to bend the tie, the mouth is formed with a series of five ribs, 136, 138, 140, 142 and 144, as shown in FIGS. 21 and 22*a*. While the tie 100 is emerging from the magazine, the ribs 136, 138, 140 act on the head and adjacent portion of the tie to bend the head through 90 degrees relative to the length of the tail, the latter being held straight and flat by the ribs 142 and 144. The manner in which the 90 degree bend is formed in the tie 100 by the ribs appears clearly from FIG. 22*a* which is a section through the mouth 128 near its exit. In FIG. 22*a*, reference 146 denotes the passage traversed by a buckle, and reference 148 denotes the passage traversed by the bent portion of the tie adjacent the buckle. The rib 136 (not visible in FIG. 22*a*) graduates away from the mouth exit to a shallower bend of greater radius, so that the bend in the tie is gradually developed as the tie progresses towards the mouth exit.

In practice, several ties 100 at the end of the bandolier 80 will be following one another to emerge from the mouth 128, being suitably advanced by an indexing means in the gun to which the magazine is attached. The previously referred to knife means which acts to break off the bridging pieces will not be operative until the leading tie has emerged from the magazine, and in any event such knife means will be disposed on the remote side of the above-mentioned indexing means from the mouth of the magazine.

FIG. 22*b* serves to show a pawl 150 provided within the mouth 128 of the magazine to prevent the bandolier 80 from sliding back inwardly of the magazine. The ties 100 are drawn out over this pawl 150 to drop in front of it as the bandolier is indexed outwardly of the magazine.

The gun shown in FIGS. 23 to 29 will now be described, which gun uses the bandolier and magazine of FIGS. 18 to 22. The tool has a casing 200 housing a longitudinally movable pusher rod 212, the construction of which is shown in FIG. 26. The pusher rod 212 is connected through member 214 at the rear of the tool to the piston rod 216 of a (preferably pneumatic) cylinder/piston assembly, the cylinder being referenced by 218. A trigger 220 is operable against the restoring action of a trigger spring 222 to actuate a change-over valve 224 thereby to drive the pusher rod 212 forwardly via the piston 216 and connecting member 214. Additionally, a nose loop operating rod 226 is coupled to the rear of the tool through member 228 and pin 230 to the pusher rod 212. The nose loop 232 is normally urged closed by a torsion spring 234 (see also FIGS. 25 and 25A), whereby the operating rod 226 is normally urged longitudinally in the forward direction.

During an initial part of the forward movement of the pusher rod 212, operating rod 226 follows in the forward direction under the action of the torsion spring 234. As indicated in FIG. 25, only a relatively small movement of a nose loop link 236 is necessary to complete closure of the nose loop 232. Following such nose loop closure, the member 228 separates from the stop pin 230 as the forward movement of the pusher rod 212 continues. Forward and rear guides for the nose loop operating rod 226 are indicated at 238 and 240. The member 228 also constitutes a valve change-over striker (see also FIG. 27), whereby a return longitudinal movement of the piston 216 is initiated at the end of its forward movement, so that at the end of an operating cycle the cylinder/piston assembly and changeover valve is restored to its original condition ready for further actuation by the trigger 220. In the direction of return movement of the pusher rod 212, the valve changeover striker 228 re-engages the nose loop enabling pin 230 towards the end of its rearward stroke, and in completing it stroke drives the operating rod 226 rearwardly to re-open the nose loop 232.

In FIG. 24, reference 242 denotes a handle associated with the trigger 220, and reference 244 denotes a handle cover. The body of the changeover valve 224 is located within the handle.

A prime purpose of the continued forward movement of the pusher rod 212, after the nose loop 232 has closed e.g. around a bundle to be secured, is to drive a tie which has been entered into the tool around a channel defined between the closed nose loop and a bundle to be secured.

Ties are entered from a magazine 248 (see also FIG. 28), in which a bandolier of ties is wound in a spiral helix of increasing diameter, as shown and described in FIGS. 18 to 22. During each operating cycle, one tie is advanced into the tool from the magazine 248 and is severed from the bandolier. One such tie 250, having a head 252, is shown in FIG. 24, in its position of initial insertion into the tool by advance from the magazine 248. It is to be noted that the tie 250 is bent through approximately ninety degrees at a point 254 adjacent its head 252, so that the aperture in the head is orientated in the longitudinal direction of the tool.

In order to effect indexing and severing of the ties, the tool incorporates a longitudinally extending index bar 256 (see also FIG. 28). This bar 256 is mounted for rotation against the action of a torsion spring 258 on spindle 260, under the drive of an index operating cam 262, which cooperates with a cam driving slot 264 in the push rod 212. The rod 212 drives the index bar 256 rotationally during the initial part of its forward movement, raising a shearing blade to cut an individual tie free from the bandolier. When the cam 262 is at full travel after this action it remains at full travel, its toe sliding along the side of the rod 212. The index bar 256 is therefore not rotated during the latter part of the forward movement of the pusher rod 212.

Thus, when the pusher rod 212 continues its forward movement after closure of the nose loop 232, a tie 250 is already in its initial position in the tool. The front end of the rod therefore engages the head 252 of the tie, and pushes the tie around the closed nose loop. During such forwards movement the end of the tie opposed to the head (toe) is deflected downwards by a pair of opposed ramps 265, one of which is shown in FIG. 25 so as to enter a channel in the nose loop and pass right round the bundle. The front end of the rod pushes the head between two spring loaded combination head catching and tie cut off pawls, which will prevent any rearward movement of the head of the tie when the pusher rod commences its return stroke. Towards the end of the forward movement of the pusher rod 212, the tail of the tie emerges rearwardly from the nose loop to re-enter the front of the tool casing 210 in the rearward direction, in line with the apertured head 252, which it then enters. Further movement of the pusher rod 212 completes the stroke, pushing the head between the combination head catching and tail cut-off pawls and simultaneously engaging the tie tail toe teeth with sprag 302. The pusher rod 212 now reverses and commences its rearward movement, pulling the tie tail and leaving the head of the tie held by the combination head catching and tie cut-off pawls.

The rod 212 now draws back the tie tail, engaged between the sprag and the roof of the breech in the casing, drawing it through the head of the tie over the heads internal ratchet teeth. The tie body (tail) teeth thus engage both with the internal head teeth and the rod sprag teeth. This tensioning action pulls the tie body out from between the ramps 265 (FIG. 25), the distance between the ramps having been carefully chosen to be just less than the tie body width so that downwards deflection of the toe occurs on forwards driving, but there is only moderate resistance to pull-out on tensioning. This action tensions the bundle, and pressure builds up inside the cylinder. The body end of the cylinder is mounted on a rocking arm 268 by a mounting pin 272. The rocking arm 268 is pivoted to the tool body by a pin 270, and retained by a notch cam 266 (attached to or formed integrally with arm 268) engaged by a spring loaded plunger 282.

The increasing pressure in the cylinder 218 of the cylinder/piston drive, as the tie is tensioned, develops an increasing force on the cam 266 tending to cause said cam to release from the spring-loaded plunger 282. When the pressure in the cylinder 218 builds to a certain preset level, the cam 266 releases, thus causing the cylinder to drive the rocking arm 266 with a sharp, short movement into contact with the tie-cutting pawl device so as to sever the tail of the tie protruding through the apertured head. One or more air channels 278 enable ejection of cut-off tails from the tool.

The amount of tensioning applied to the tie 250 is adjustable by a tension adjuster 280 which comprises the indent plunger 282 engaging the cam 266 under the pressure of a detent compression spring 284. Adjustment of this adjuster 280 alters the level to which the pressure in the cylinder 218 must build up before the cam 266 releases itself from the plunger 282.

Continued reverse movement of the pusher rod 212 allows the index bar cam 262 to re-enter the cam driving slot 264 in rod 212, which action operates the index mechanism, lowering a cropping blade 302 (to be described later) ready for the next tie, and also advancing a fresh tie into the tool. There is a time lag between these steps, with the blade 308 being lowered first to open the breech before the next tie is advanced. The terminal part of the reverse movement of rod 212 drives open the nose loop 232.

Additional details of important parts of the tool mechanism are shown in FIGS. 25 to 29.

FIGS. 25 and 25A show details of the front end of the tool including the nose loop assembly. In FIG. 25, the nose loop 232 is shown closed, with the open position in dotted line. In FIG. 25A, the reference 286 denotes a nose loop pivot pin about which the nose loop is urged closed by the torsion spring 234. This pivot pin 0,tends through a profiled front end 246 to the casing 210, (see FIG. 24), which casing may conveniently be integrally made of moulded plastics material.

FIG. 25 also shows a tie tail directing ramp, referenced 300, together with the sprag 302 and sprag compression spring 304 by means of which the sprag is urged into its tie tail holding condition when the tie tail arrives through the tie head, in the latter part of the forward stroke of the pusher rod 212.

FIG. 27 shows additional details associated with the changeover valve 224, including the relative positions of valve changeover striker 228, the nose loop enable pin 230, the pusher rod 212, the nose loop operating rod 226 and the cylinder 218. Reference 288 denotes a cylinder mounting spindle.

FIGS. 28 and 28A show details of the entrance region of the tool through which ties are advanced from the magazine 248. In FIG. 28, reference 290 denotes the mouth of the casing 210 of the tool into which the magazine 248 is received. The exit of the magazine 248 has upper and lower lips 292, 294 between which the leading end of a bandolier of ties housed in the magazine is drawn towards the tool. These lips 292, 294 may be formed as integral parts of the plastics moulded magazine. A bearing post 296 supports the adjacent parts of the indexing mechanism, including the front end of the index bar 256 on spindle 260. The index bar 256, driven by an index operating cam 298 during the continued reverse stroke of the pusher rod after tensioning and cutting of one tie, moves an index finger 206 which engages the leading tie (disposed lengthwise perpendicular to the plane of the drawing) of the bandolier to advance it into the tool. Instead of the mouth of the magazine being profiled to bend the tie adjacent its head through approximately ninety degrees, for the tie to assume the condition of the tie 250 shown in FIG. 24, in the tool shown the mouth of the tool itself is profiled to bend the tie.

FIG. 28A shows the cropping mechanism by which the leading tie, having been indexed into the mouth of the tool during the preceding reverse stroke of the pusher rod, is severed from the bandolier during the next forward stroke of the pusher rod prior to engagement of the front end of the latter with the head of the tie. A cropping blade 308 is mounted on a pair of rocking levers 310 and is tensioned downwards by a spring 312 (see also FIG. 24). The cropping blade rocking levers 310 are operable by toe rollers 314 carried with the index bar 256, the latter driven under its cam drive previously referred to.

Finally, FIGS. 29, 29A and 29B show details associated with the tie tensioning and cutting mechanism. FIG. 29B shows the mounting 272 of the cylinder 218 to the rocking arm 268, which is pivotally mounted to the casing on spindle 270. Reference 316 denotes a support block for the index plunger 282 previously described.

Referring now to FIGS. 29 and 29A, the tie-cutting pawl device comprises a pair of cut-off pawls 318 connected to pawl links 320 which are primarily tensioned by spring 322. A pivot pin for the linkage is referenced 324 in FIG. 29A. Certain other details of this part of the mechanism appear in FIG. 23, including a pawl stop plate 326, the support block 328 for the adjuster and a pair of spring blades 330. The pawls 318 are held partly open by blades 330 against tension spring 322 to enable the tie to pass through. The head passes through first, when the pawls half close, then at the desired tension the rocking arm 268 is released. When the rocking arm is released from cam 266, a cam 269 on said arm 268 strikes the pawl linkage to sever the tail of the tensioned tie. Each pawl includes a post portion **318*a* mounted for rotation about its own axis and having the blade 318*b* projecting radially from its lower end, and a limb 318*c* projecting radially from its upper end to the respective link 320. The springs 330 bear against the outer surfaces of the limbs 318*c*** near the rear ends of the latter.

The embodiments of the invention in which an exclusive property or privilege is claimed are defined as follows:

1. In a combination for automatically applying an individual flexible tie from a supply of individual interconnected flexible ties around an elongate bundle of wires, each of the ties having a tie body portion having a flat tail portion and an operational head portion at opposite ends of said tie body, said combination including a tool and said supply of interconnected flexible ties, the improvement comprising:

a series of individual flexible ties assembled in the form of a belt of ties wherein the ties are disposed side-by-side in a flat plane and in generally parallel alignment with each other, said individual flexible ties being interconnected successively with one another in a predetermined spacing by integral flexible bridging portions adjacent the head and tail portions of individual ties so as to form a tie supply bandolier wherein the ties are in generally parallel alignment with each other and in generally perpendicular relation to the axes defined by the integral flexible bridging portions adjacent said tie head and tail portions, said briding portions at said head and tail portions cooperating to maintain adjacent ties in said generally parallel alignment and maintain said predetermined spacing of adjacent ties for preventing relative movement of adjacent ties and facilitating receipt of adjacent ties onto a tie tool indexing means; and a tie tool adapted to receive individual ties from said tie supply bandolier, said tie tool including indexing means for receiving said individual ties from said tie supply bandolier in said predetermined spacing, cropping means for cutting the individual ties free from the bridging portions adjacent the tie head and tail portions to separate said individual ties from said tie supply bandolier for use in said tie tool, removal means operatively associated with said cropping means for receiving and transmitting to waste said bridging portions which have been severed from said individual ties, driving means operatively associated with said indexing means for driving each individual tie so separated around said elongate bundle, guide means at the one end of said tool which directs each individual tie so separated from said bandolier around said elongate bundle in a manner by which said tie tail passes through said apertured head to interlock therein, means for engaging said free end of said tie tail (once passed through said apertured head) and driving it lengthwise of itself to tension the tie around said bundle being tied, and a knife for cutting the tail behind said tie head and tension-sensing means for actuating said knife when a predetermined tension in said tie is reached.

2. The automatic tie tool of claim 1, wherein said indexing means includes a rotary drum rotatable about an axis parallel to an individual tie of said tie supply bandolier when said tie supply bandolier is received within said tie tool such that individual ties of said tie supply bandolier are engaged by said indexing means in a tail forward position within said tool, said rotary drum having a plurality of grooves axially extending along its periphery for receiving individual ties which are to be successively advanced by stepped rotation of said drum into said tail forward position, and means to receive said integral bridging portions adjacent said head and tail portions of successive individual ties of said tie supply bandolier.

3. A bandolier of flexible ties intended for use in an automatic tie tool for applying an individual tie around an elongate bundle of wires and having means for separating individual ties from the bandolier during the successive application of said ties around said bundle of wires the individual ties of said bandolier being joined together adjacent one another, wherein said bandolier comprises a plurality of individual flexible ties assembled in the form of a continuous belt, each individual tie having a flat tail and apertured head at opposite ends thereof, said individual ties being disposed side-by-side in a flat plane, and in generally parallel alignment with each other and being interconnected successively with one another by integral bridging portions adjacent the tails and apertured heads of said ties, said integral bridging portions cooperating to maintain adjacent ties in said generally parallel alignment and to maintain said predetermined spacing between adjacent ties for preventing relative movement of adjacent ties and facilitating receipt of each of said ties in said bandolier onto an indexing means within said tie tool.

4. A bandolier according to claim 3, wherein a plurality of continuous belt sections of flexible ties are joined together by plastics welding to form said bandolier.

* * * * *

UNITED STATES PATENT AND TRADEMARK OFFICE

CERTIFICATE OF CORRECTION

PATENT NO. : 4,640,319

DATED : February 3, 1987

INVENTOR(S) : John G. Walker

It is certified that error appears in the above-identified patent and that said Letters Patent is hereby corrected as shown below:

Column 5, line 25, "Wen" should read --When--.
Column 6, line 63, "to" should read --To--.
Column 10, line 17, "(toe)" should read --(the toe)--.
Column 11, line 8, "302" should read --308--; line 22, "0,tends" should read --extends--.
Column 12, line 54, "briding" should read --bridging--.

Signed and Sealed this

Twenty-second Day of May, 1990

*Attest:*

HARRY F. MANBECK, JR.

*Attesting Officer*

*Commissioner of Patents and Trademarks*